US009042770B2

(12) United States Patent
Sato

(10) Patent No.: US 9,042,770 B2
(45) Date of Patent: May 26, 2015

(54) IMAGE FORMING APPARATUS

(71) Applicant: CANON KABUSHIKI KAISHA, Tokyo (JP)

(72) Inventor: Koki Sato, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/921,432

(22) Filed: Jun. 19, 2013

(65) Prior Publication Data

US 2014/0016962 A1 Jan. 16, 2014

(30) Foreign Application Priority Data

Jul. 12, 2012 (JP) ..... 2012-156121

(51) Int. Cl.
*G03G 15/00* (2006.01)
*G03G 21/16* (2006.01)
*B41J 13/00* (2006.01)

(52) U.S. Cl.
CPC ..... *G03G 21/1623* (2013.01); *G03G 15/00* (2013.01); *G03G 2221/1654* (2013.01); *G03G 2221/1678* (2013.01); *G03G 21/16* (2013.01); *B41J 13/00* (2013.01)

(58) Field of Classification Search
CPC ..... G03G 12/16
USPC ..... 399/107
See application file for complete search history.

(56) References Cited

U.S. PATENT DOCUMENTS 6,055,394 A * 4/2000 Suda et al. ..... 399/107
6,246,853 B1 * 6/2001 Suzuki et al. ..... 399/262
7,330,679 B2 * 2/2008 Kweon ..... 399/111
7,343,118 B2 * 3/2008 Ahn et al. ..... 399/124
7,444,099 B2 * 10/2008 Eguchi ..... 399/107
7,831,173 B2 * 11/2010 Kusukawa et al. ..... 399/114
8,055,151 B2 * 11/2011 Asahina et al. ..... 399/110
8,401,426 B2 * 3/2013 Nieda ..... 399/114
8,752,825 B2 * 6/2014 Watanabe ..... 271/213
2002/0150404 A1 * 10/2002 Matsuzaka et al. ..... 399/111
2005/0081889 A1 * 4/2005 Nakano et al. ..... 134/6
2005/0265746 A1 * 12/2005 Jung et al. ..... 399/111
2006/0093397 A1 * 5/2006 Yamaoka ..... 399/110
2006/0120756 A1 * 6/2006 Ahn et al. ..... 399/124
2006/0159486 A1 * 7/2006 Kweon ..... 399/110

(Continued)

FOREIGN PATENT DOCUMENTS

JP 10-026922 A 1/1998
JP 10026922 * 1/1998 ..... B41J 13/00

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus includes a cover and a supporting member. The cover includes a connecting portion, the supporting member has a first path which guides the connecting portion and a second path which is bifurcated from the first path. When the connecting portion is located at an end of the first path, the cover is supported at a first opening angle, and when the connecting portion is located at an end of the second path, the cover is supported at a second opening angle which is larger than the first opening angle. When the supporting member upwardly rotates in a state where the cover is supported at the first opening angle, the cover rotates so as to interwork with the rotation of the supporting member, the connecting portion moves from the first path to the second path by its own weight of the cover.

21 Claims, 5 Drawing Sheets

(56) References Cited

U.S. PATENT DOCUMENTS

2007/0077085 A1* 4/2007 Kitamura et al. ..... 399/110
2007/0147882 A1* 6/2007 Igarashi ..... 399/110
2007/0223947 A1* 9/2007 Ohkawa et al. ..... 399/27
2009/0074446 A1* 3/2009 Idehara et al. ..... 399/107
2009/0263155 A1* 10/2009 Murano ..... 399/107
2011/0052253 A1* 3/2011 Nieda ..... 399/110
2014/0016962 A1* 1/2014 Sato ..... 399/107

* cited by examiner

IMAGE FORMING APPARATUS

This application claims the benefit of Japanese Patent Application No. 2012-156121, filed Jul. 12, 2012, which is hereby incorporated by reference herein in its entirety.

BACKGROUND OF THE INVENTION

1. Field of the Invention

The present invention relates to an image forming apparatus which is capable of switching an opening angle of a cover which opens/closes a sheet conveyance path in multiple levels.

2. Description of the Related Art

In an image forming apparatus of the related art, a paper jam (hereinafter, referred to as a "jam") may occur in a sheet conveyance path so the conveyance path is configured to have an openable and closable cover. Further, the cover is opened/closed not only when the jammed sheet is removed but also when a component such as an intermediate transfer belt, a fixing device, or a conveying roller, which is disposed in the conveyance path, is attached/detached or exchanged.

Japanese Patent Laid-Open No. 10-26922 discloses a configuration including an opening angle setting portion which sets an opening angle of the cover in multiple levels. According to the above configuration, a space which is required to open and close the cover may be desirably adjusted. For example, when the opening angle has two levels, the opening angle at the time of jam recovery is set to be small so that a processing space required for the jam recovery may be reduced. Further, the opening angle is switched to be large to conveniently attach/detach a component.

As a configuration which switches the opening angle of the cover, a double action system where a cover is lifted to a point which switches the opening angle is suggested. In the lifted status, a member which supports the cover is manipulated to switch the opening angle. Further, there is a method that switches the opening angle by releasing a fixing member which fixes the cover at a predetermined opening angle.

However, ease in exchanging a consumable part or responding to a problem which occurs in a part is required so that it is more likely that a user attaches, detaches, or exchanges the part, without a service man going to the location of the image forming apparatus to attach, detach, or exchange the part. When the user attaches/detaches the part, it is difficult to switch the opening angle of the cover as planned if a method that switches the opening angle of the cover is complex. In this case, the part may not be easily attached/detached.

Further, if the cover is unpredictably opened with the cover set at a large opening angle when it is expected that the cover is set at a small opening angle, a fixing member may be released in such a way that the cover is dropped with a momentum that the part is likely to be broken.

SUMMARY OF THE INVENTION

It is desirable to provide an image forming apparatus which is capable of increasing job efficiency and certainty in switching the opening angle by simplifying a job of switching the opening angle of the cover in a mechanism which is capable of setting the opening angle of the cover in multi-levels.

An image forming apparatus which forms an image on a recording medium includes a cover which is rotatably supported to a main body of the apparatus; and a supporting member which is rotatably supported to the main body of the apparatus and supports the cover at a plurality of predetermined opening angles. Any one of the cover and the supporting member includes a connecting portion which connects the cover to the supporting member and the other one of the cover and the supporting member has a first path which guides the connecting portion and a second path which is bifurcated from the first path. When the connecting portion is located at an end of the first path, the cover is supported at a first opening angle, and when the connecting portion is located at an end of the second path, the cover is supported at a second opening angle which is larger than the first opening angle. The first path and the second path are formed such that when the supporting member upwardly rotates from a state where the cover is supported at the first opening angle, the cover rotates so as to interwork with the rotation of the supporting member and if the connecting portion reaches the bifurcating point of the first path and the second path, the connecting portion moves from the first path to the second path by its own weight of the cover.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the drawings.

Figure 1:
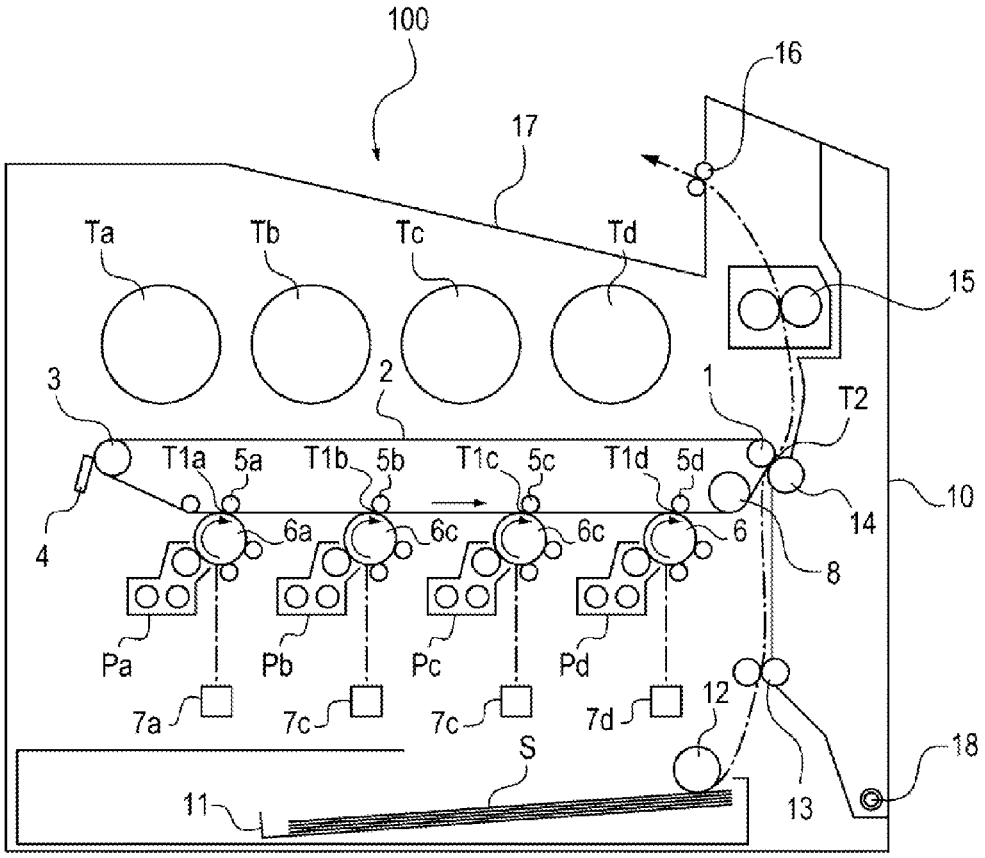
FIG. 1 is a diagram illustrating an entire configuration of an image forming apparatus according to a first exemplary embodiment of the present invention.

<First exemplary embodiment> (Entire configuration of image forming apparatus) An entire configuration of an image forming apparatus according to an exemplary embodiment of the present invention will be described. FIG. 1 is a schematic diagram of a color image forming apparatus which uses an electrophotographic system. The image forming apparatus 100 is an intermediate transfer tandem type image forming apparatus in which four colors, that is, yellow (Y), magenta (M), cyan (C), and black (Bk) image forming portions are disposed in parallel on an intermediate transfer belt 2. Further, in FIG. 1, a direction perpendicular to the sheet is a longitudinal direction of the apparatus.

The image forming apparatus 100 includes process cartridges Pa, Pb, Pc, and Pd which form a toner image. The process cartridges use toners of different colors, that is, yellow, magenta, cyan, and black, respectively, but other configurations of each of the process cartridges are same.

In FIG. 1, surfaces of photosensitive members 6*a*, 6*b*, 6*c*, and 6*d* which are driven to rotate in a clockwise direction are exposed and scanned by exposure devices 7*a*, 7*b*, 7*c*, and 7*d* which are driven based on a signal of image information and an electrostatic latent image is formed thereon. The electrostatic latent image is developed by the process cartridges Pa, Pb, Pc, and Pd as a toner image. Thereafter, a predetermined pressurization force and a primary transfer bias are applied by primary transfer units T1*a*, T1*b*, T1*c*, and T1*d* and the toner image is formed on the intermediate transfer belt 2.

Primary transfer bias rollers 5*a*, 5*b*, 5*c*, and 5*d* and transfer cleaning device 4 are in contact with the intermediate transfer belt 2. Further, the intermediate transfer belt 2 is stretched by a secondary transfer inner roller 1, a tension roller 3, and a secondary transfer upstream roller 8 which serve to transmit a driving force to the intermediate transfer belt 2 and is an endless belt which is conveyed and driven in a counterclockwise direction in the drawing.

The primary transfer bias rollers 5*a*, 5*b*, 5*c*, and 5*d* nip the intermediate transfer belt 2 between the primary transfer bias rollers 5*a*, 5*b*, 5*c*, and 5*d* and the photosensitive members 6*a*, 6*b*, 6*c*, and 6*d* to form a primary transfer nip. An image forming process is performed at timing when an upstream color toner image which is primarily transferred is overlaid on the intermediate transfer belt 2 by sequentially passing through the primary transfer nip according to conveyance driving of the intermediate transfer belt 2. Therefore, four color toner images are formed on the intermediate transfer belt 2 and then conveyed to a secondary transfer portion T2.

A recording sheet S (recording medium) which is loaded and accommodated in a recording sheet storage case 11 is fed by a feeding roller 12 one by one and a skewed feeding thereof is corrected by a registration roller 13 so that the recording sheet is sent to the secondary transfer portion T2 at an appropriate timing. In the secondary transfer portion T2, the intermediate transfer belt 2 is nipped between the secondary transfer inner roller 1 and a secondary transfer outer roller 14 to form a nip and a four color toner image which is formed on the intermediate transfer belt 2 are secondarily transferred onto the recording sheet S.

The recording sheet S which has been secondarily transferred is conveyed to the fixing device 15 where a toner image on the recording sheet S is fixed. The recording sheet S is discharged outside the apparatus by a pair of discharge rollers 16 and sequentially loaded in a stack portion 17.

Figure 2:
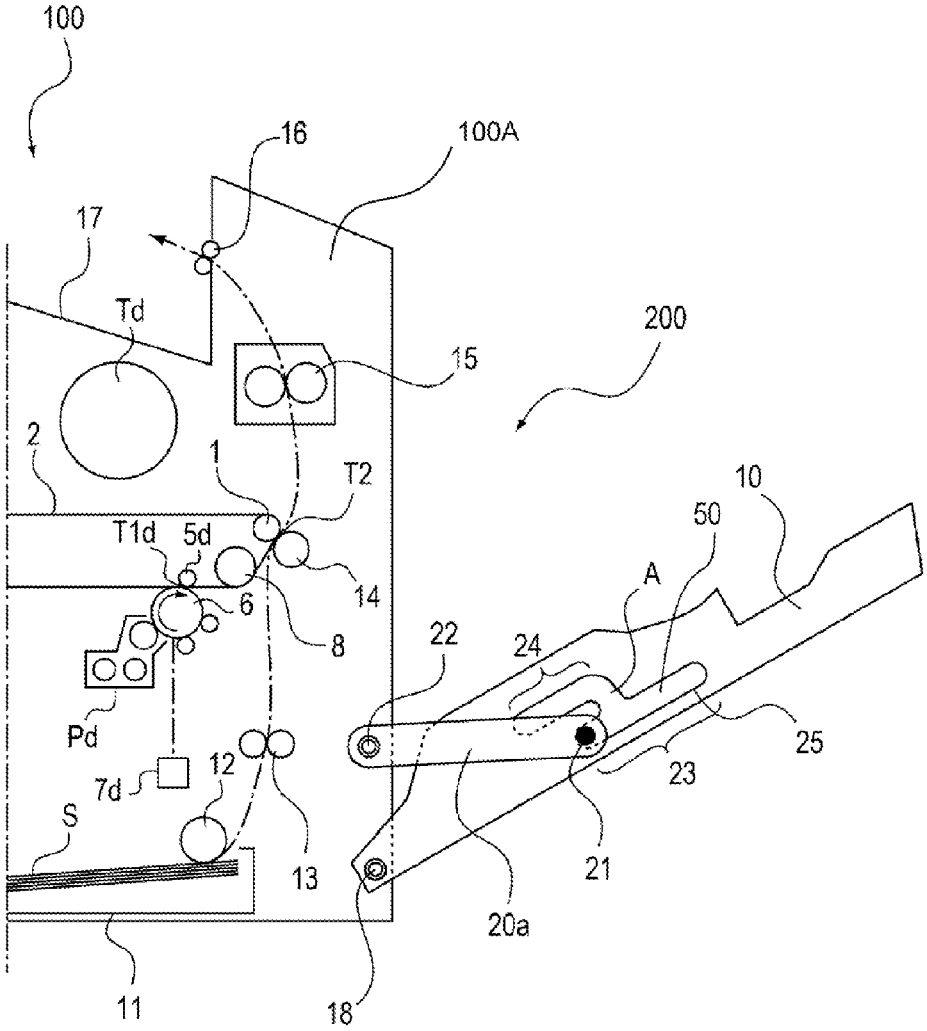
FIG. 2 is a diagram illustrating a configuration of an opening/closing mechanism of the image forming apparatus according to the first exemplary embodiment of the present invention which illustrates a status where a cover is opened in a first level.
Figure 3:
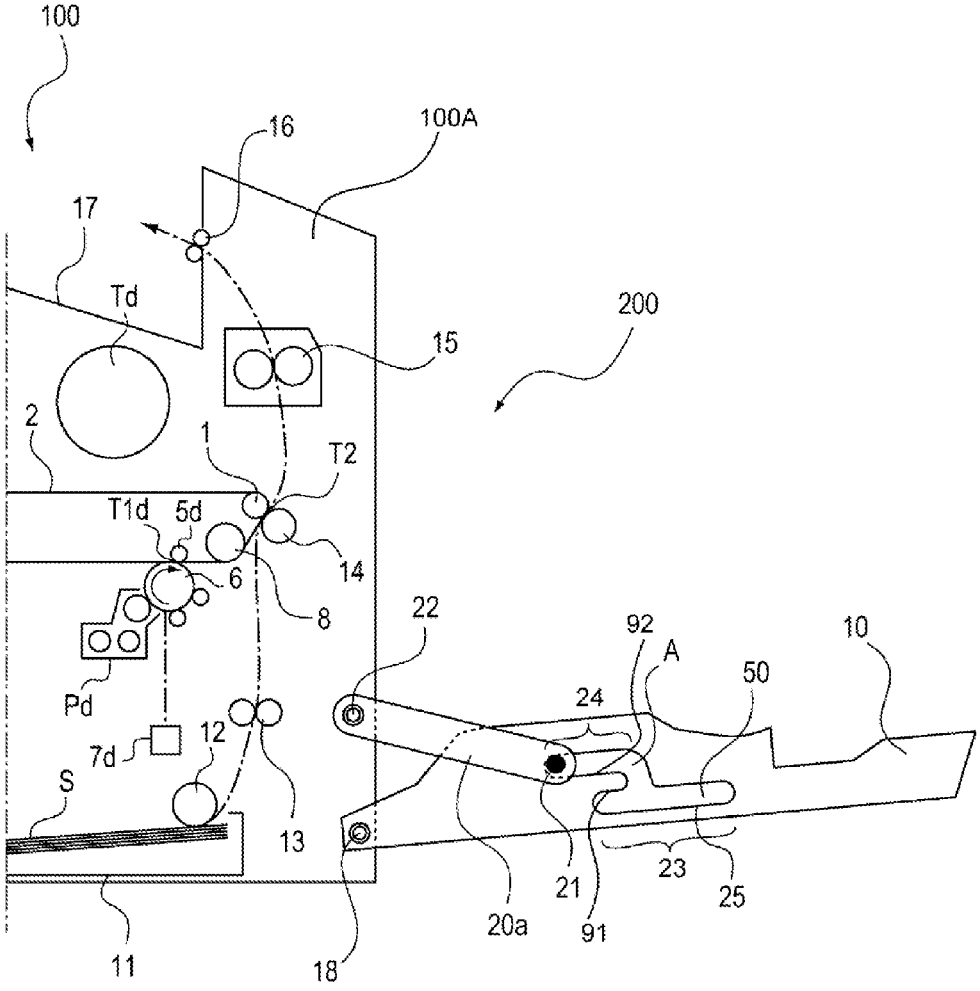
FIG. 3 is a diagram illustrating a configuration of the opening/closing mechanism of the image forming apparatus according to the first exemplary embodiment of the present invention which illustrates a status where the cover is opened in a second level.

(Configuration of opening/closing mechanism) FIGS. 2 and 3 are diagrams illustrating a configuration of the opening/closing mechanism 200 according to the exemplary embodiment of the present invention. FIG. 2 is a diagram illustrating a status when a cover of the opening/closing mechanism is opened in a first level and FIG. 3 is a diagram illustrating a status when the cover is opened in a second level. As illustrated in FIGS. 2 and 3, an opening angle of the cover 10 of the opening/closing mechanism 200 may be set at two levels.

The recording sheet S may be jammed in a conveyance path from the registration roller 13 to the fixing device 15 so that a cover 10 which opens and closes the conveyance path is provided at a right side of the image forming apparatus 100. The cover 10 is rotatably supported around a horizontal axis in a longitudinal direction by a shaft 18 provided in the main body 100A of the apparatus. The cover 10 illustrated in FIG. 2 as being provided on the right side is an example and the cover 10 may be provided at the other side.

A cover supporting member 20*a* which is capable of supporting the opening angle of the cover 10 at two levels (at a plurality of predetermined angles), a shaft 21 (connecting portion) which connects the cover supporting member 20*a* and the cover 10, and a shaft 22 which connects the cover supporting member 20*a* and the main body 100A of the apparatus are provided between the cover 10 and the main body 100A of the apparatus. The cover supporting member 20*a* is supported to the main body 100A of the apparatus so as to rotate around the shaft 22 as a rotation center.

Further, a groove 50 which guides (leads) the shaft 21 is provided in the cover 10. The groove 50 includes two paths, that is, a first path 23 and a second path 24 and the first path 23 and the second path 24 are connected to each other at a bifurcating point A. In other words, the second path 24 is bifurcated from the bifurcating point A of the first path 23. An intermediate portion of the first path 23 (a first groove) and the second path 24 (a second groove) communicate with each other by the bifurcating point A which is a communicating portion.

When jam recovery is performed by an operator, as illustrated in FIG. 2, the cover 10 is opened in a first level (at a first opening angle) where the opening angle of the cover 10 is set to be small.

In this case, a left end (one end) of the first path 23 is located in a position of the shaft 21 so that the cover 10 is fixed at the first opening angle. Here, the bifurcating point A is disposed on a surface which is opposite to a surface 25. The shaft 21 is in contact with surface 25 in the first path 23 so as to lean against the first path 23 by the weight of the cover supporting member 20*a* during the opening/closing operation of the cover 10. In other words, during the opening/closing operation of the cover 10, the shaft 21 is in contact with a surface 25 which is an opposite side of the bifurcating point A in the first path 23 by the weight of the cover supporting member 20*a*. By doing this, unless the cover supporting member 20*a* is lifted up on purpose so that the shaft 21 passes through the bifurcating point A and is inserted into the second path 24, the cover 10 is not opened wider than an angle of the first level (where the opening angle is set to be small) when the opening/closing operation is simply performed by the cover 10.

Further, when a component of the fixing device 15 or the intermediate transfer belt 2 is attached/detached or exchanged, as illustrated in FIG. 3, the cover 10 is opened in a second level (at a second opening angle) where the opening angle of the cover 10 is set to be large.

In this case, a left end (one end) of the second path 24 is located in a position of the shaft 21 so that the cover 10 is fixed at the second opening angle (see FIG. 3). When the component is attached/detached or exchanged, a switching operation is performed in order to open the cover 10 at the opening angle of the second level. The switching operation is performed in a state where the cover 10 is opened at the opening angle of the first level.

As illustrated in FIG. 2, in a state where the left end of the first path 23 is disposed in the position of the shaft 21, the cover supporting member 20*a* is lifted up so that the cover supporting member 20*a* rotates in a counterclockwise direction with the shaft 22 as a rotation center. The cover 10 which interworks with the rotation of the cover supporting member so as to be lifted up by the cover supporting member 20*a* rotates in a counterclockwise direction with the shaft 18 as a rotation center. Eventually, if the shaft 21 reaches the bifurcating point A, since the cover 10 leans against the cover supporting member 20*a* by its own weight, the switching operation is performed such that the shaft 21 is inserted into the second path 24. That is, an upper edge (guiding portion) 91 of the first path 23 between the left end of the first path 23 and the bifurcating point A guides the shaft 21 to the bifurcating point A according to the operation of lifting up the cover supporting member 20*a*.

In other words, when the cover supporting member 20*a* rotates upwardly from a state where the cover 10 is supported at the first opening angle, the cover 10 rotates so as to interwork with the rotation of the cover supporting member 20*a*. Therefore, the first path 23 and the second path 24 are formed such that if the shaft 21 reaches the bifurcating point A of the first path 23 and the second path 24, the shaft 21 moves from the first path 23 to the second path 24 by its own weight of the cover 10.

Further, when the cover 10 is closed from the opening angle of the second level, if the cover 10 is closed by the operator, the shaft 21 leans against a surface facing the bifurcating point A of the second path 24 by its own weight so that the shaft 21 is switched into the first path 23 without requiring a special operation and may return to a predetermined waiting position when the cover 10 is closed.

In other words, when the cover 10 rotates upwardly from a status where the cover 10 is supported at the second opening angle, the cover supporting member 20*a* rotates so as to interwork with the rotation of the cover. Therefore, the first path 23 and the second path 24 are formed such that when the shaft 21 reaches the bifurcating point A, the shaft 21 moves from the second path 24 to the first path 23 by its own weight of the cover supporting member 20*a*. That is, a lower edge (a second guiding portion) 92 of the second path 24 between the left end of the second path 24 and the bifurcating point A guides the shaft 21 to the bifurcating point A according to the operation of lifting up the cover 10.

As described above, in the opening/closing mechanism 200, an operation of switching from the opening angle at the first level to the opening angle at the second level is performed by a simple one action. Just lifts up the cover supporting member 20*a*. Therefore, the operator does not need to hold the cover 10 separately from the cover supporting member 20*a* in order to match the shaft 21 with the bifurcating point A, but job efficiency is improved.

Further, when the switching operation is performed, the cover supporting member 20*a* is embraced by hands of the operator so that the cover 10 is not unpredictably opened from the opening angle of the first level to the opening angle of the second level with a momentum, which prevents the part from being broken due to an impact. Further, if the cover 10 returns to a status where the cover 10 is closed from the opening angle of the second level, the cover 10 may return to a predetermined waiting position without requiring a specific operation. Further, unless the operator operates switching on purpose, the cover 10 is not opened from the closed status to the opening angle of the second level with a momentum, which may prevent the part from being broken due to an impact.

Figure 4:
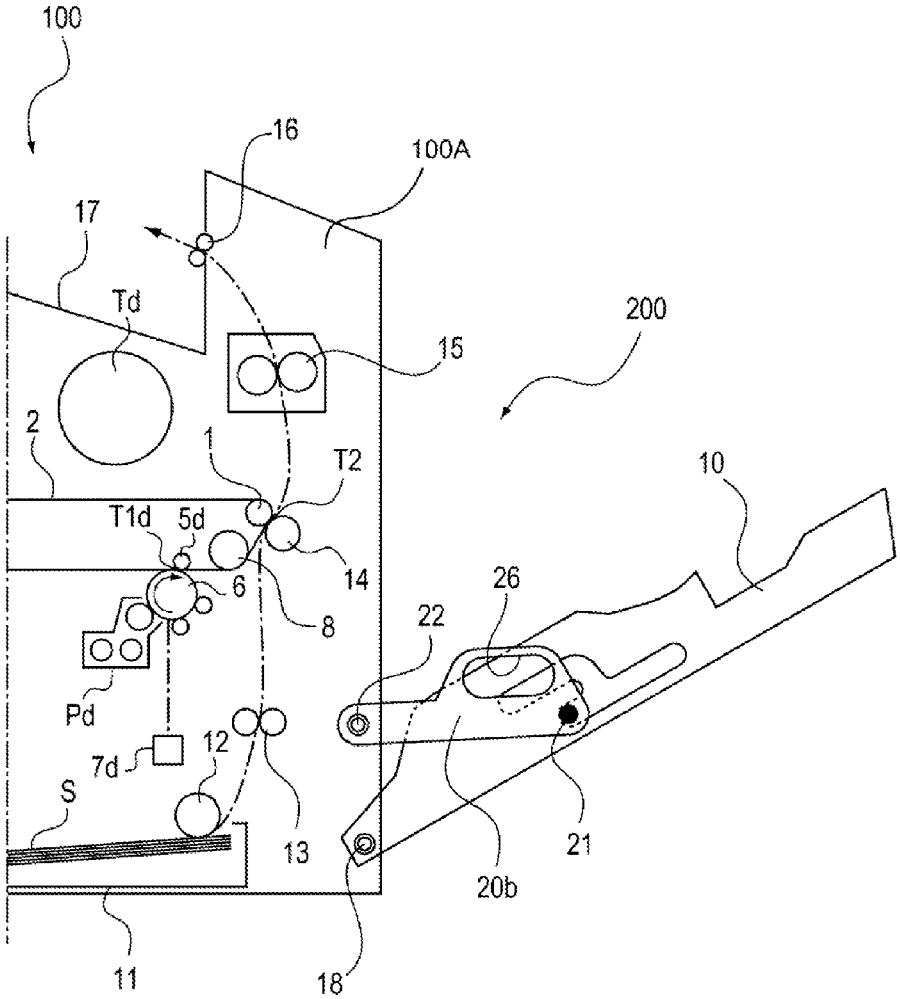
FIG. 4 is a diagram illustrating a modified example of the opening/closing mechanism of the image forming apparatus according to the first exemplary embodiment of the present invention.

(Configuration of handle portion) FIG. 4 is a diagram illustrating a modified example of the opening/closing mechanism of the image forming apparatus according to the exemplary embodiment.

In the opening/closing mechanism illustrated in FIGS. 2 and 3, the cover supporting member 20*a* has a simple oval shape. In the meantime, as illustrated in FIG. 4, a cover supporting member 20*b* may have a hole shape 26 serving as a handle portion which is grasped by hands.

The hole shape 26 is provided so as to serve as a handle when the cover supporting member 20*b* is lifted up. Therefore, it is possible to help the operator to understand the operation and transfer the operating force without wasting the operating force, which increases job efficiency. Further, the hole shape 26 which serves as the handle portion may be a protrusion shape which is grasped by hands. The hole shape 26 is not limited to the hole if it is grasped by hands.

<Second exemplary embodiment> An image forming apparatus according to another exemplary embodiment of the present invention will be described. Same or similar configurations as the image forming apparatus according to the first exemplary embodiment are denoted by the same reference numerals and redundant description will not be provided.

Figure 5:
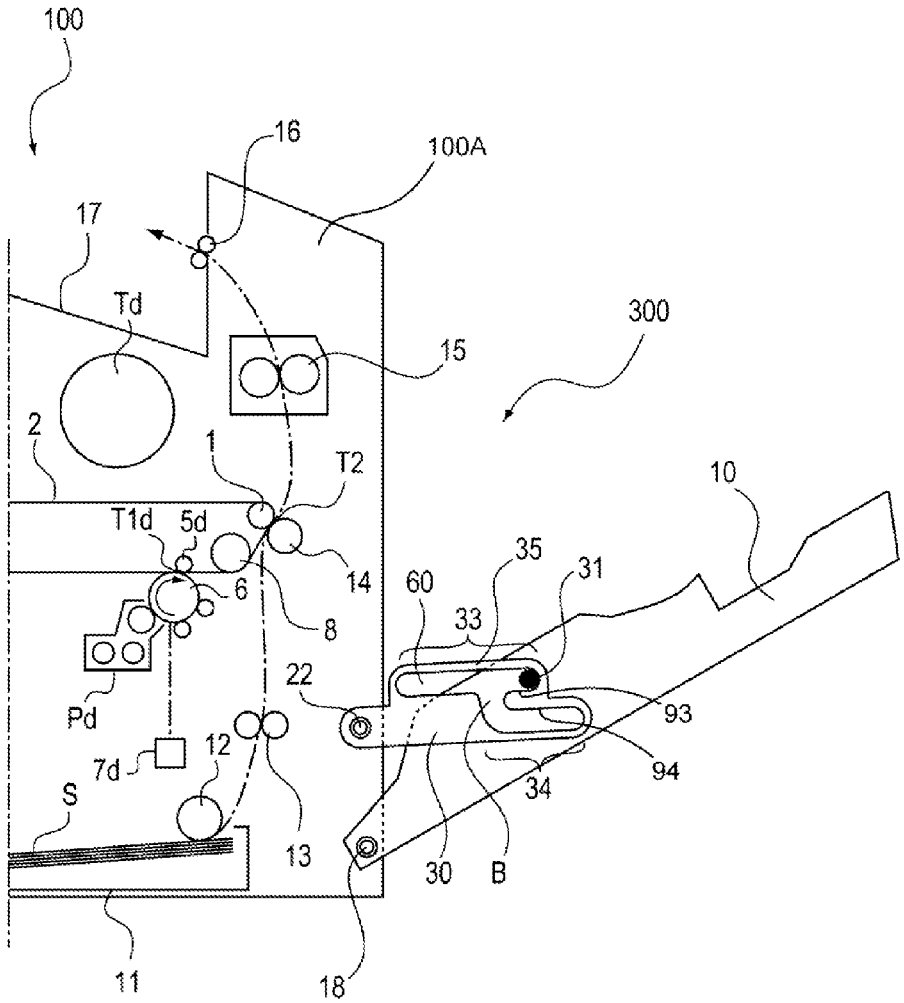
FIG. 5 is a diagram illustrating a configuration of an opening/closing mechanism of an image forming apparatus according to a second exemplary embodiment of the present invention.

FIG. 5 is a diagram illustrating a configuration of an opening/closing mechanism according to the exemplary embodiment.

In the opening/closing mechanism 200 of the image forming apparatus according to the first exemplary embodiment, the cover 10 includes the first path 23 and the second path 24. In this exemplary embodiment, an opening/closing mechanism 300 as illustrated in FIG. 5 is used and a cover supporting member 30 includes a first path 33 and a second path 34.

The opening/closing mechanism 300 includes a cover supporting member 30 which is capable of supporting an opening angle of the cover 10 in two levels (at a plurality of predetermined angles), a shaft 31 (connecting portion) which connects the cover supporting member 30 and the cover 10, and a shaft 22 which connects the cover supporting member 30 and the main body 100A of the apparatus, between the cover 10 and the main body 100A of the apparatus. The cover supporting member 30 is supported to the main body 100A of the apparatus so as to rotate around the shaft 22 as a rotation center. Further, a groove 60 which is guided (led) by the shaft 31 is provided in the cover supporting member 30. The groove 60 includes two paths, that is, a first path 33 and a second path 34 and the first path 33 and the second path 34 are connected to each other at a bifurcating point B. An intermediate portion of the first path 33 (a first groove) and the second path 34 (a second groove) communicate with each other by the bifurcating point B which is a communicating portion.

When the jam recovery is performed, as illustrated in FIG. 5, the cover 10 is opened in a first level (at a first opening angle) where the opening angle of the cover 10 is set to be small. In FIG. 5, a right end (one end) of the first path 33 is located in the position of the shaft 31 so that the opening angle of the cover 10 is fixed. Here, the bifurcating point B is disposed on a surface which is opposite to a surface 35 onto which the cover supporting member 30 is in contact with the shaft 31 so as to lean against the shaft 31 by its own weight during the opening/closing operation of the cover 10. By doing this, unless the cover supporting member 30 is lifted up on purpose so that the shaft 31 passes through the bifurcating point B and is inserted into the second path 34, when the opening/closing manipulation is simply performed by the cover 10, the cover 10 is not opened wider than an angle of first level where the opening angle is set to be small.

Similarly to the opening/closing mechanism 200, when the components of the fixing device 15 or the intermediate transfer belt 2 are attached/detached or exchanged, the cover 10 needs to be opened at the second level where the opening angle of the cover 10 is set to be large. In this case, as illustrated in FIG. 5, the cover supporting member 30 is lifted up in a horizontal direction from a status where the right end of the first path 33 is located in the position of the shaft 31. By doing this, the cover supporting member 30 rotates in a counterclockwise direction with the shaft 22 as a rotation center and the cover 10 which interworks with the rotation of the cover supporting member 30 so as to be lifted up by the cover supporting member 30 rotates in a counterclockwise direction with the shaft 18 as a rotation center. Therefore, if the shaft 31 reaches the bifurcating point B, since the cover 10 leans against the cover supporting member 30 by its own weight, the switching operation is performed such that the shaft 31 is inserted into the second path 34. That is, a lower edge (guiding portion) 93 of the first path 33 between the right end of the first path 33 and the bifurcating point B guides the shaft 31 to the bifurcating point B according to the operation of lifting up the cover supporting member 30. Further, if the cover 10 is lifted up from a status where the right end of the second path 34 is located in the position of the shaft 31, the shaft 31 is inserted into the first path 33. That is, an upper edge (a second guiding portion) 94 of the second path 34 between the right end of the second path 34 and the bifurcating point B guides the shaft 31 to the bifurcating point B according to the operation of lifting up the cover 10.

That is, according to the first and second exemplary embodiments, any one of the cover and the cover supporting member has a shaft which connects the cover and the cover supporting member and the other one has a first path which guides the shaft and a second path which is bifurcated from the first path.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus which forms an image on a recording medium, comprising:

a cover which is rotatably supported by a main body of the apparatus; and a supporting member which is rotatably supported by the main body of the apparatus at a rotation center disposed on the main body, the supporting member supporting the cover at a plurality of predetermined opening angles, wherein one of the cover and the supporting member includes a connecting portion which connects the cover and the supporting member, the other one of the cover and the supporting member has a first path which guides the connecting portion and a second path which is bifurcated from the first path, when the connecting portion is located at an end of the first path, the cover is supported at a first opening angle, and when the connecting portion is located at an end of the second path, the cover is supported at a second opening angle which is larger than the first opening angle, and the first path and the second path are formed such that the connecting portion moves from the first path to the second path by the weight of the cover when the supporting member upwardly rotates about the rotation center from a state that the cover is supported at the first opening angle.

2. The image forming apparatus according to claim 1, wherein the first path and the second path are formed so that, when the cover rotates upwardly from a state where the cover is supported at the second opening angle, the supporting member rotates with the rotation of the cover and, when the connecting portion reaches the bifurcating point, the connecting portion moves from the second path to the first path by the weight of the supporting member.

3. The image forming apparatus according to claim 1, wherein the supporting member includes a handle portion, which is grasped by hands.

4. The image forming apparatus according to claim 1, wherein the connecting portion is provided in the cover and the first path and the second path are provided in the supporting member.

5. The image forming apparatus according to claim 1, wherein the connecting portion is provided in the supporting member and the first path and the second path are provided in the cover.

6. The image forming apparatus according to claim 1, wherein the connecting portion includes a shaft.

7. The image forming apparatus according to claim 1, wherein the first path and the second path have grooves.

8. The image forming apparatus according to claim 7, wherein the grooves of the first path and the second path are continuous at the bifurcating point.

9. The image forming apparatus according to claim 1, wherein the connecting portion includes a shaft which is provided in the cover, and the first path and the second path include a groove which is provided in the supporting member and engaged with the shaft.

10. The image forming apparatus according to claim 9, wherein, when the shaft is engaged with the first path of the groove, a weight of the supporting member acts so that the shaft is in contact with a surface which is opposite to the bifurcating point in the first path.

11. The image forming apparatus according to claim 1, wherein the connecting portion includes a shaft which is provided in the supporting member, and the first path and the second path include a groove which is provided in the cover and engaged with the shaft.

12. The image forming apparatus according to claim 11, wherein when the shaft is engaged with the first path of the groove, a weight of the supporting member acts so that the shaft is in contact with a surface which is opposite to the bifurcating point in the first path.

13. An image forming apparatus comprising:

a main body of the apparatus;

a cover which is rotatably supported by the main body of the apparatus;

a supporting member which supports the cover in an open state, one end being rotatably supported to the main body of the apparatus and a connecting portion provided in the other end being connected to the cover;

a first groove which is formed in the cover and to which the connecting portion of the supporting member is slidably connected, wherein the connecting portion of the supporting member is engaged with an end of the first groove so that the cover is supported by the supporting member in an open state;

a second groove which is formed in the cover and to which the connecting portion of the supporting member is slidably connected, wherein the connecting portion of the supporting member is engaged with an end of the second groove so that the cover is supported by the supporting member in an open state;

a communicating portion which is provided in the cover and communicates the first groove with the second groove; and a guiding portion which is provided in the first groove and guides the connecting portion of the supporting member from the end of the first groove to the communicating portion during an upwardly moving operation of the supporting member.

14. The image forming apparatus according to claim 13, further comprising:

a second guiding portion which is provided in the second groove and guides the connecting portion of the supporting member from the end of the second groove to the communicating portion during an upwardly moving operation of the cover.

15. An image forming apparatus comprising:

a main body of the apparatus;

a cover which is rotatably supported by the main body of the apparatus, the cover having a connecting portion;

a supporting member which supports the cover in an open state and is connected to the connecting portion of the cover, one end being rotatably supported by the main body of the apparatus;

a first groove which is formed in the supporting member and to which the connecting portion of the cover is slidably connected, wherein the connecting portion of the cover is engaged with an end of the first groove so that the cover is supported by the supporting member in an open state;

a second groove which is formed in the supporting member and to which the connecting portion of the cover is slidably connected, wherein the connecting portion of the cover is engaged with an end of the second groove so that the cover is supported by the supporting member in an open state;

a communicating portion which is provided in the supporting member and communicates the first groove with the second groove; and a guiding portion which is provided in the first groove and guides the connecting portion of the cover from the end of the first groove to the communicating portion during an upwardly moving operation of the supporting member.

16. The image forming apparatus according to claim 15, further comprising:

a second guiding portion which is provided in the second groove and guides the connecting portion of the cover from the end of the second groove to the communicating portion during an upwardly moving operation of the cover.

17. An image forming apparatus comprising:

a main body of the apparatus;

a cover which is rotatably supported by the main body of the apparatus;

a connecting portion;

a groove portion including a first groove to which the connecting portion is slidably connected and a second groove to which the connecting portion is slidably connected, the connecting portion being engaged with an end of the first groove so that the cover is supported in an open state and the connecting portion being engaged with an end of the second groove so that the cover is supported by the supporting member in an open state;

a supporting member having (i) one end connected to the main body of the apparatus and other end being connected the cover and (ii) one of the connecting portion and the groove portion;

a communicating portion which communicates the first groove with the second groove; and a guiding portion which is provided in the first groove and guides the connecting portion from the end of the first groove to the communicating portion during an upwardly moving operation of the supporting member.

18. The image forming apparatus according to claim 17, further comprising:

a second guiding portion which guides the connecting portion from the end of the second groove to the communicating portion according to the operation of upwardly moving the cover.

19. The image forming apparatus according to claim 17, wherein the cover has the groove portion, the communicating portion and the guiding portion, and the supporting member has the connecting portion.

20. The image forming apparatus according to claim 17, wherein the supporting member has the groove portion, the communicating portion and the guiding portion, and the cover has the connecting portion.

21. The image forming apparatus according to claim 17, Wherein, when the connecting portion is engaged with the end of the first groove, the cover is supported at a first opening angle and, when the connecting portion is engaged with the end of the second groove, the cover is supported at a second opening angle which is larger than the first opening angle.

* * * * *